United States Patent [19]

Hote

[11] 4,035,268

[45] July 12, 1977

[54] PROCESS FOR THE CONTROL OF MERCURY CATHODE ELECTROLYSIS CELLS

[75] Inventor: Andre Hote, Jarrie, France

[73] Assignee: Produits Chimiques Ugine Kuhlmann, Paris, France

[21] Appl. No.: 647,867

[22] Filed: Jan. 9, 1976

Related U.S. Application Data

[63] Continuation of Ser. No. 505,462, Sept. 12, 1974, abandoned.

[30] Foreign Application Priority Data

Sept. 17, 1973 France ..... 73.33213

[51] Int. Cl.$^2$ ..... C25B 1/40

[52] U.S. Cl. ..... 204/99; 204/225; 204/228

[58] Field of Search ..... 204/99, 225, 228, 245

[56] References Cited

U.S. PATENT DOCUMENTS

| | | | |
|---|---|---|---|
| 3,723,285 | 3/1973 | Daga et al. | 204/228 |
| 3,817,846 | 6/1974 | Gebauer et al. | 204/99 |
| 3,844,913 | 10/1974 | Warren | 204/99 |
| 3,853,723 | 12/1974 | Mack | 204/99 |
| 3,900,373 | 8/1975 | Ralston, Jr. | 204/99 |
| 3,926,750 | 12/1975 | Adachi et al. | 204/99 |
| 3,983,025 | 9/1976 | Ralston, Jr. | 204/225 |

FOREIGN PATENT DOCUMENTS

| | | | |
|---|---|---|---|
| 2,013,358 | 4/1970 | France | 204/225 |
| 78,557 | 12/1970 | Germany | 204/225 |

*Primary Examiner*—John H. Mack
*Assistant Examiner*—Aaron Weisstuch
*Attorney, Agent, or Firm*—Brooks, Haidt, Haffner & Delahunty

[57] ABSTRACT

Methods for control and protection of anode assemblies in mercury cathode cells for the electrolysis of alkali metal and alkaline earth metal chlorides so as to provide commands or an alarm when the load on an anode assembly exceeds a predetermined level so that the anode assembly or assemblies can be raised, the determination being made by comparing the difference between the load for each assembly and the mean of all assemblies with a predetermined upper level, and also desirably comparing the difference with a preselected lower level and determining the electrolysis voltage and comparing it with a desired lower electrolysis voltage to provide a command for lowering the anode assembly or assemblies involved, generally with a delay in the lowering command and with the raising of the anode assemblies taking precedence over the lowering thereof.

3 Claims, 1 Drawing Figure

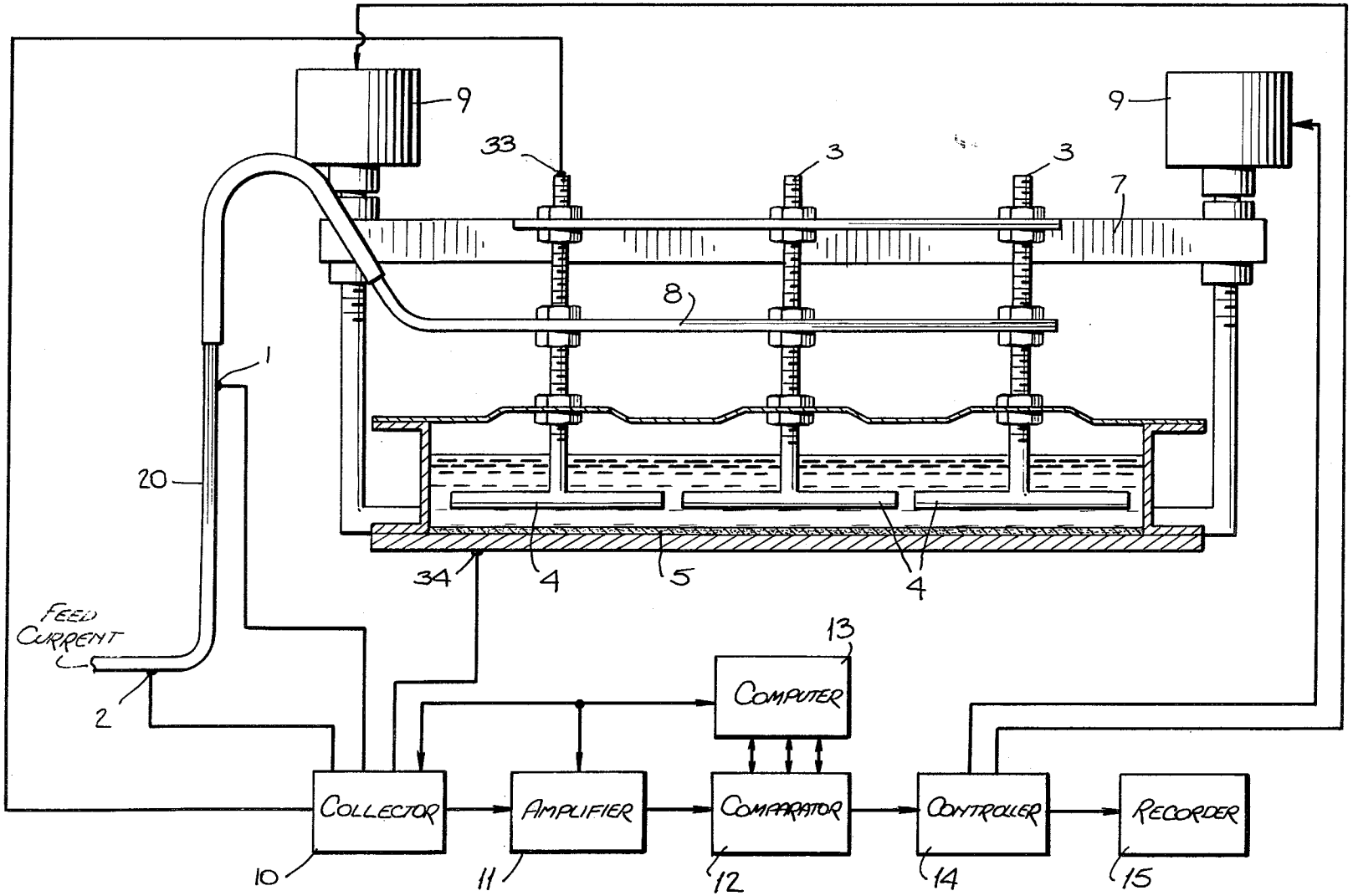
9
7
3
3
4
4
8
5
33
34
9
1
20
2
FEED CURRENT
COLLECTOR
10
AMPLIFIER
11
COMPARATOR
12
COMPUTER
13
CONTROLLER
14
RECORDER
15

PROCESS FOR THE CONTROL OF MERCURY CATHODE ELECTROLYSIS CELLS

This is a continuation of application Ser. No. 505,462, filed Sept. 12, 1974, now abandoned.

BACKGROUND OF THE INVENTION

The present invention relates to the regulation of electrolytic cells, and more particularly, to methods for the automatic adjustment of the interpolar distance between the anodes and the cathodes used for electrolysis of alkali metal and alkaline earth metal chlorides with a mercury cathode functioning at high current densities to produce chlorine and alkaline hydroxides.

In each cell the anodic assembly is comprised of plural elements which are mechanically carried by beams, the height of which beams can be adjusted. Generally, each anode element is dimensionally stable or is itself individually adjustable in height in its connection to the beam. Thus, from an electrical standpoint, the anodic elements are generally associated in groups, each group being fed energy by a special conductor called a current supply or feed bar.

The goal of the makers and users of chlorine plants at all times is to utilize a minimum amount of power for each ton of chlorine produced in the cells and to operate with the highest possible current density. In order to attain this goal, it is necessary to control very precisely the electrolysis voltage. A consideration of the factors going into the required electrolysis voltage shows that it is composed of the following terms for each anodic element:

a. The voltage drop in the metal supporting the anode.
b. The voltage drop at the contact point of the metal support with the anode.
c. The voltage drop in the anode itself.
d. The thermodynamic oxidation potential of the chloride ion.
e. The anodic overvoltage.
f. The voltage drop in the electrolyte.
g. The thermodynamic reduction potential of the alkali or alkaline earth metal at the mercury cathode.
h. The cathodic overvoltage, and
i. The voltage drop in the mercury and cathodic steel work.

Of the foregoing terms, (a), (c), and (i) are determined by the fabrication of the cell; the terms (d), (e), (g), and (h) are characterized by the particular electrochemical processes used; (b) is determined by the quality of the anode wiring; and (f) is determined by the interpolar distance between the anodes and cathode and by the electrolyte temperature.

When, instead of considering each individual factor, the entire cell assembly is considered, two additional factors must be taken into account:

First of all, the mercury cathode layer is not even but is an irregular surface, and secondly, since it is formed of several elements the anode is not plane. It is therefore simplistic to speak of a single interpolar distance, and on the contrary, a great number of individual distances between the different anodic elements and the portion of the mercury layer situated immediately beneath each element must be considered to be scattered about an average interpolar distance.

As a result of this, the average electrolysis voltage is a complex function depending upon the construction technology of the cell, the thermal gradient along the cell, the current strength and density, the temperature and concentration of electrolyte, the mercury amalgam concentration in the cathode, and the mean interpolar distance. Among all these factors, the interpolar distance has a strong influence on the electrolysis voltage, and it is equally the factor which is the most easily altered. Thus, to optimize the mean electrolysis voltage, that is to say, the specific energy consumption, it is sufficient to control the mean interpolar distance, but this must be done carefully.

Experience has indeed shown that in order to get the cell to function at optimum conditions of voltage at a given operating intensity, it is necessary that the cell be at electrical equilibrium and then that the mean interpolar distance be as small as possible, taking into consideration the irregularities in shape of the cathodic layer and the anode assembly. Starting with this state of the art, it has been verified that the operation deteriorates over a period of time even with dimensionally stable anodes. If the cell is left to run by itself, short circuits occur after a period of time and the anode elements are damaged. To be able to control this, it is necessary to detect the short circuit condition promptly and then to move the anode-carrying beam holding the elements involved and thereby adjust the elements in order to get back to the optimum voltage.

If these operations were all to be executed manually, it would be expensive and slow and would moreover risk a delay in response after a short circuit is detected.

There is accordingly a commercial need to carry out the process automatically, so as to permit in the shortest possible time, on the one hand, information to be obtained on the electrical situation of the cell, and on the other hand to detect and arrest the short circuits before they become destructive. Finally, there is a need automatically to regulate the interpolar distance in the electrolysis cells so that the specific energy consumption of the cells is optimized. This need is considerably more acute when high current densities are used in the anodes.

Various methods have been suggested to deal with these problems. It is well-known that the interpolar distance can generally be controlled by mechanical adjustment of the anode height in relation to the cathode. Generally, an electric or a hydraulic motor is used, and this raises the possibility that the anode height can be raised or lowered in relation to the surface of the mercury layer. Judicious selection of the control parameter and the processing of the parameter to control the motor are the basic elements of an automatic control system for the interpolar distance.

It has been proposed for example to measure the voltage variations or the rate of change of voltage variations in the conductors carrying anode current. This parameter generally does not afford the required sensitivity efficiently to protect the anode assembly and permit control, particularly with dimensionally stable metallic anodes.

THE INVENTION

According to this invention, a gauge or measuring parameter has been found and a novel method of handling the information furnished by this measurement can be used automatically to regulate the interpolar distance. This parameter is the individual load intensity traversing each anode group, a group comprising one anode or a plurality of anodes.

The novel method of handling this information comprises continuously or at short intervals comparing each of the intensities, thus measured, to the mean intensity and this can be carried out as follows:

Detect the individual variations between the intensity of an anode group and the average intensity and, when said variation exceeds a predetermined limit, providing a signal to sound an alarm so that an adjustment can be made. Going beyond this, the signal can be used, in addition to sounding the alarm, to supply a command to raise the beam holding the anodes which are at fault.

Going even further, both in comparison with another predetermined limit and also a reckoning of the actual voltage of the cell in relation to a desired level, furnishing a set of signals which control the necessary movement of the beams so that the voltage is continuously optimized.

The invention is further described by reference to the FIGURE which shows a schematic diagram of an electrolysis cell utilizing a process according to the invention.

The step in the determination of this working parameter of the cell and of the handling of this information is essentially based on the following three observations according to the present invention:

1. A short circuit is usually localized and is not instantaneous; it is preceded by an initiation stage during which the electrical imbalance of the cell increases.
2. The greater the separation between the anodes and the cathode, the more the current distribution among the anodes is uniform. Conversely, the smaller the interpolar distance, the greater the variation of the individual anode currents from the average value of anode currents.
3. If the interpolar distance of the cell in perfect equilibrium is decreased, a general short-circuit occurs and the cell then acts as a homogeneous conductor.

From these various observations follows the principle of controlling or regulating the interpolar distance between the anodes and the cathode of an electrolysis cell according to the present invention. In the first stage, the intensity is controlled among all the anodes; and in the second stage the interpolar distance is automatically adjusted to the optimum so as to maintain the distribution of intensities and obviate short circuits.

The measurement of the intensity in the conductors having large cross-sections, such as those supplying the electrolysis cells, is difficult. After a number of trials, it has been found that the potential difference between two fixed points on the conductors carrying the current to each group of anodes can be used. This potential difference is proportional to the current load intensity in the anode or anodes of the group served by the particular conductor.

The present invention thus provides a method for controlling and/or protecting the anode assemblies of cells for the electrolysis of alkali metal chlorides or alkaline earth metal chlorides utilizing a mercury cathode and multiple anodes enabling operation at high intensity and/or high current density, wherein the raising and lowering of the anode-carrying beams is automatically obtained.

The aforementioned process is characterized by the following features:

1. The intensity, $i$, in each electrically connected group of anodes is measured. The mean intensity $\bar{i}$ is calculated and the deviation from this average intensity, that is, $i-\bar{i}$, is determined for each anode group.
2. The electrolysis voltage, $V_r$, is measured over the anodes carried by each beam between the anode and the cathode. The reference voltage, $V_{ref}$, is determined according to the formula $V_{ref}=k_1+k_2 i_A$, wherein $i_A$ is the anode current density and $k_1$ and $k_2$ are characteristic of each installation, depending on the process and technology of the cell.
3. The deviation $(i-\bar{i})$ is compared to an upper threshold limit, $\Sigma$, which can be preselected and controlled and/or can be a function of the current density used in the process, of the cell structure, of the degree of anode erosion and the other variables which influence the electrolysis voltage, and a command is given to raise all the beams for which the deviation is above the aforesaid upper limit, for whatever anode groups are supported by the beam.
4. The deviation $(i-\bar{i})$ is compared to a lower threshold limit, $\sigma$, which can be preselected and controlled and/or to a function of the current density of the processes used, of the degree of anode erosion, of the cell construction, and of other variables influencing the electrolysis voltage, and a timed or not timed order is given to lower all the beams for which the electrolysis voltage is above the desired voltage determined by the current density of the process, the cell structure, the degree of anode erosion and all other variables influencing the electrolysis voltage.
5. The commands to raise the electrodes have priority over the commands to lower them and an order to raise can immediately follow any earlier order.
6. If the mean electrolysis voltage $\overline{V}_r$ or a beam voltage deviates below the safe voltage, which can be preselected or regulable and/or a function of the current density, the degree of anode erosion, or the structure of the cell and all other variables influencing the electrolysis voltage, an order to raise one or more of the beams carrying the anodes will be given until the $\overline{V}_r$ is again greater than the safe voltage for the beam or beams involved.

In practice, if over a group of whatever anodes there is, the relationship $(i-\bar{i})-\Sigma>0$ prevails (whatever $V_r$ may be, a raising command will be given to the beam which carries that anode group and maintained until the foregoing inequality changes sign.

If over all the groups of anodes of beams, $(i-\bar{i})-\sigma<0$ and $V_r>V_{ref}+V_o$ ($V_o$ being an additional adjustable voltage), the system will give a lowering command at time, $T_o$, which may only follow a raise order after lapsing of time, $T_1$, or a lower order after lapsing of time, $T_3$.

As soon as $\overline{V}_r<(V_{ref}+S_r)$, where $S_r$ is an adjustable preselected voltage, the control system gives a raise order to all the bus beams until the inequality changes sign.

Turning to the single FIGURE representing one cell in an automatic control system for cells operating according to the present invention, the process will be further described. In an electrolytic chlorine-producing cell utilizing a mercury cathode 5, the feed current is distributed among the several bus bars 8 to the cell anodes 4.

The current distribution cables 3 on anodes 4 are supported by anode carrier beam 7 which can mechanically displace the anodes in relation to mercury layer 5 by means of drive motors 9. This construction can be used to regulate the height of anode supporting beam 7 in relation to the plane of mercury layer 5. Additionally, each anode 4 can be manually positioned in relation to the other anodes as necessary.

The operation of the process according to the present invention utilizes as a measure the current strength in each feed cable. In the FIGURE, each measurement is carried out by determining the voltage drop between two fixed points, shown at 1 and 2, on feed cable 20. All the intensity measurements in the feed cables are gathered by collector 10 which also measures the electrolysis voltage between points 33 and 34. All these measurements are amplified in appropriate amplifiers 11. The comparisons between the intensity in each conductor and on one hand the average intensity; and on the other hand the upper limit, $\Sigma$, and the lower limit, $\sigma$; the comparison between the electrolysis voltage, $V_r$, and the selected safe conductor voltages are effected by comparator 12 in which the values are introduced in the form of voltage, these values being a function on the basis of the intensity according to cell construction, the electrolysis process, and all the other variables which influence the electrolysis voltage. These functions are elaborated in computer 13 according to the collected and amplified values from collector 10 and amplifiers 11.

The raise and lower commands for the anode-carrying beams are sent to controller 14 which effects the mechanical raising or lowering of beams 7 by controlling motors 9. These orders, as well as the amplified signals, are registered on recorder 15.

In a simplified mode of operation according to the invention the process is limited to the protection of the anode assemblies. This second mode of operation is characterized by the following points:

1. The parameter used is the current intensity in each homogeneous anode group, the group comprising either one or a plurality of anodes.
2. The current intensity, $i$, of each group is measured. The mean current intensity, $\bar{i}$, is calculated and the difference is calculated for each group.
3. Simultaneously over each group of anodes the difference, $(i - \bar{i})$, is compared with a preselected and controlled threshold, $\Sigma$.
4. If over any group of anodes there is, $(i = \bar{i})\Sigma > 0$, an alarm indicates the faulty group of anodes and/or provides an order to raise the anodes to the anode-carrying beam, and this alarm continues until the inequality changes sign.

The measurements and their processing can be effected by the use of an all electric system or a pneumatic system, but it is preferred to use an electronic analog or digital system.

The intensities can be amplified in differential amplifiers and the average obtained digitally or by analog. The constants and the instructions are introduced by means of auxiliary voltages which can be a function of the different parameters, such as intensity, anode group position in the cell, degree of erosion of the anode group, or any of the other variables influencing the value.

The advantages of the present invention are, as stated above, the control of the homogeneous distribution of the current fed to the electrolysis cell through the different current feed conductors for the anodes, and the signals produced are treated in order to correct, or permit the correction of, deviations which manifest themselves in real time and thus protect the anodes against overload and premature wear or erosion.

In addition, the continuous comparison of electrolysis voltage to desired predetermined and regulable voltages which may be a function of all the foregoing parameters permits the lowering of the beams while assuring protection of the anodes. As stated earlier, this results in optimum voltage in the cell interior.

The following Examples are given to illustrate embodiments of the invention as it is presently preferred to practice it. It will be understood that these Examples are illustrative, and the invention is not to be considered as restricted thereto except as indicated in the appended claims.

All the following Examples show the results obtained utilizing a cell equipped with the claimed apparatus as shown in the FIGURE. The cell used in the Examples has the following characteristics:

| | |
|---|---|
| Total Anode Surface Area | 19.8 m² |
| Cathode Surface Area | 20.0 m² |
| Slope of the Mercury Cathode | 15 percent |
| Number of Anode Carrying Beams | 6 |
| Number of Metallic Anodes | 36 |
| Number of Current Conductors | 18 |

The cell is used for the electrolysis of an aqueous sodium chloride solution having an input concentration of 310 g/l and an output concentration of 275 g/l at a mean temperature of 70° C. The values of the various parameters are as follows:

$k_1 = 3.10$ volts
$k_2 = 0.10$ ohm/m²
$i_A = I/19.8$ amp/m²
$V_{ref} = 3.10 + 0.10\ (I/19.8)$
$\Sigma_1 = 3.5$ mv on Beam 1
$\Sigma_2 = 3.5$ mv on Beam 2
$\Sigma_3 = 3.5$ mv on Beam 3
$\Sigma_4 = 4.0$ mv on Beam 4
$\Sigma_5 = 4.0$ mv on Beam 5
$\Sigma_6 = 4.0$ mv on Beam 6
$V_o = -100$ mv
$S_r = -300$ mv
$\sigma = 2.5$ mv
$T_o = 0.1$ sec.
$T_1 = 2.8$ min.
$T_3 = 4.5$ min.

In the apparatus used the following parameters or equalities $v_{ref}$, $V_o$, and $S_r$ are amplified by a coefficient of multiplication equal to 1.5. All the values for $\Sigma$ and the value for $\sigma$ are amplified by a factor of 400, as is $i$.

Examples 1, 2, and 3 show the instantaneous results obtained with a cell operating at different loads. Example 4 shows the average performance of a cell during 80 days of continuous operation. Example 5 shows the results obtained with a system utilizing only protection of the anode assemblies.

EXAMPLE I

Feed current = 253,000 amperes
$V_{ref} = 4.38$ volts

| Anode Ref No. | Potential Difference (mv Before Amplification) | Current (Amp) | Beam Ref No. | Actual Voltage ($V_r$ Before Amplification in mv) |
|---|---|---|---|---|
| 1 | 16.5 | 13,772 | | |
| 2 | 15.5 | 12,937 | 1 | 4.23 |
| 3 | 15.5 | 12,937 | | |
| 4 | 14.0 | 11,686 | | |
| 5 | 14.9 | 12,437 | 2 | 4.22 |
| 6 | 18.9 | 15,775 | | |
| 7 | 17.7 | 14,774 | | |
| 8 | 16.4 | 13,689 | 3 | 4.16 |
| 9 | 18.3 | 15,275 | | |
| 10 | 18.4 | 15,358 | | |
| 11 | 14.5 | 12,103 | 4 | 4.19 |
| 12 | 16.6 | 13,856 | | |
| 13 | 19.0 | 15,859 | | |
| 14 | 17.8 | 14,857 | 5 | 4.19 |
| 15 | 18.1 | 15,108 | | |
| 16 | 17.7 | 14,774 | | |
| 17 | 16.7 | 13,939 | 6 | 4.20 |
| 18 | 16.6 | 13,856 | | |
| Average | 16.8 | 14,055 | | 4.20 |

The specific power consumption is 3,338 kwh per metric ton of chlorine produced.

EXAMPLE II

Feed current = 250,000 amperes $V_{ref}$ = 4.36 volts

| Anode Ref No. | Potential Difference (mv Before Amplification) | Current (Amp) | Beam Ref No. | Actual Voltage ($V_r$ Before Amplification in mv) |
|---|---|---|---|---|
| 1 | 16.3 | 13,594 | | |
| 2 | 15.4 | 12,843 | 1 | 4.28 |
| 3 | 16.6 | 13,844 | | |
| 4 | 17.6 | 14,678 | | |
| 5 | 15.6 | 13,010 | 2 | 4.28 |
| 6 | 16.9 | 14,094 | | |
| 7 | 15.5 | 12,927 | | |
| 8 | 16.2 | 13,511 | 3 | 4.28 |
| 9 | 16.7 | 13,928 | | |
| 10 | 15.9 | 13,260 | | |
| 11 | 16.2 | 13,511 | 4 | 4.29 |
| 12 | 15.9 | 13,260 | | |
| 13 | 18.2 | 15,179 | | |
| 14 | 16.9 | 14,095 | 5 | 4.31 |
| 15 | 16.5 | 13,761 | | |
| 16 | 17.9 | 14,929 | | |
| 17 | 17.5 | 14,595 | 6 | 4.31 |
| 18 | 17.9 | 14,929 | | |
| Average | 16.6 | 13,889 | | 4.29 |

The specific power consumption is 3,412 kwh per metric ton of chlorine.

EXAMPLE III

Feed current = 171,000 amperes $V_{ref}$ = 3.96 volts

| Anode Ref No. | Potential Difference (mv Before Amplification) | Current (Amp) | Beam Ref No. | Actual Voltage ($V_r$ Before Amplification in mv) |
|---|---|---|---|---|
| 1 | 10.6 | 9,529 | | |
| 2 | 10.9 | 9,799 | 1 | 3.83 |
| 3 | 11.3 | 10,158 | | |
| 4 | 11.0 | 9,889 | | |
| 5 | 11.4 | 10,249 | 2 | 3.88 |
| 6 | 11.1 | 9,979 | | |
| 7 | 9.2 | 8,271 | | |
| 8 | 9.9 | 8,900 | 3 | 3.89 |
| 9 | 10.0 | 8,990 | | |
| 10 | 10.0 | 8,990 | | |
| 11 | 9.0 | 8,091 | 4 | 3.86 |
| 12 | 10.2 | 9,170 | | |
| 13 | 11.3 | 10,158 | | |
| 14 | 12.8 | 11,507 | 5 | 3.82 |
| 15 | 11.9 | 10,698 | | |
| 16 | 10.0 | 8,990 | | |
| 17 | 9.4 | 8,451 | 6 | 3.84 |
| 18 | 10.2 | 9,170 | | |
| Average | 10.5 | 9,500 | | 3.86 |

The specific power consumption is 3,068 kwh per ton of chlorine produced.

EXAMPLE IV

Results obtained after 80 days of continuous operation are as follows:

Feed current = 249,500 amperes $V_{ref}$ = 4.36 volts

Average voltage $V_r$ = 4.25 volts

Specific power consumption = 3,378 kwh per metric ton of chlorine produced.

EXAMPLE V

| Anode Ref No. | Potential Difference (mv Before Amplification and Before Anode Beam Adjustment) | Beam Ref No. | Beams Requiring a Raise Command | Potential Difference (mv Before Amplification and After Beam Adjustment) |
|---|---|---|---|---|
| 1 | 20.1 | | | 19.8 |
| 2 | 18.0 | 1 | Raise | 17.8 |
| 3 | 18.3 | | | 18.0 |
| 4 | 14.0 | | | 14.3 |
| 5 | 14.9 | 2 | | 15.3 |
| 6 | 15.1 | | | 15.5 |
| 7 | 20.1 | | | 19.8 |
| 8 | 17.5 | 3 | Raise | 17.4 |
| 9 | 19.3 | | | 19.0 |
| 10 | 16.5 | | | 16.7 |
| 11 | 14.5 | 4 | | 14.6 |
| 12 | 16.6 | | | 16.7 |
| 13 | 16.0 | | | 16.0 |
| 14 | 16.1 | 5 | | 16.1 |
| 15 | 16.5 | | | 16.5 |
| 16 | 16.2 | | | 16.2 |
| 17 | 16.2 | 6 | | 16.2 |
| 18 | 16.3 | | | 16.3 |

What is claimed is:

1. A method for the adjustment and protection of plural anode assemblies in mercury cathode alkali metal chloride and alkaline earth metal chloride electrolysis cells, which method consists of the essential steps of controlling the raising and lowering of the beams carrying the anodes by a. comparing the difference $i - \bar{i}$ for each anode assembly, where $i$ is the current in each given anode assembly carried by a beam and $\bar{i}$ is the mean of all anode assembly currents, with a preselected upper threshold current and issuing a command to raise each beam for which the difference exceeds the upper threshold, b. comparing the difference with a preselected lower threshold current for each given anode assembly and giving a temporised command to lower each beam for which the difference is less than the lower limit and for which at the same time the electrolysis voltage is greater than the desired voltage, the raise command taking priority over the lower command, and c. giving a raise command to all beams when the average electrolysis voltage, $\overline{V}_r$, becomes lower than a predetermined safe voltage, the raise command being continued until $\overline{V}_r$ is above the safe voltage.

2. A method according to claim 1 wherein the even distribution of electrolysis cell load between the several anode feed conductors supplying current to each anode assembly is continuously controlled and the resulting signals are processed continuously to correct the difference in a time interval within the selected electrolysis voltages.

3. A method according to claim 1 wherein the measurements and handling thereof are carried out by an electronic system coupled to a computer.

* * * * *

UNITED STATES PATENT AND TRADEMARK OFFICE

CERTIFICATE OF CORRECTION

PATENT NO. : 4,035,268

DATED : July 12, 1977

INVENTOR(S) : ANDRE HOTE

It is certified that error appears in the above-identified patent and that said Letters Patent are hereby corrected as shown below:

Column 5, line 45, after "difference" insert --(i-$\bar{i}$)--.

Column 5, line 49, change "i=$\bar{i}$" to --i-$\bar{i}$--.

Column 9, line 1, change "i-i" to --i-$\bar{i}$--.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*